US005996859A

United States Patent [19]

Beck

[11] Patent Number: 5,996,859

[45] Date of Patent: Dec. 7, 1999

[54] HINGED DISPENSING CLOSURE

[75] Inventor: James M. Beck, Long Grove, Ill.

[73] Assignee: Creative Packaging Corp., Buffalo Grove, Ill.

[21] Appl. No.: 09/081,811

[22] Filed: May 20, 1998

[51] Int. Cl.[6] ..... B65D 47/00

[52] U.S. Cl. ..... 222/556; 215/237

[58] Field of Search ..... 222/556; 215/237, 215/224, 225, 303, 238; 220/281, 283

[56] References Cited

U.S. PATENT DOCUMENTS

| | | | |
|---|---|---|---|
| 4,193,519 | 3/1980 | Dubach et al. | 222/556 X |
| 4,236,653 | 12/1980 | Gach | 222/556 X |
| 4,793,502 | 12/1988 | Beck | 220/235 |
| 5,007,555 | 4/1991 | Beck | 215/235 |
| 5,271,524 | 12/1993 | Marston | 222/525 X |
| 5,386,918 | 2/1995 | Neveras et al. | 222/556 X |
| 5,400,912 | 3/1995 | Brown et al. | 215/237 X |
| 5,547,091 | 8/1996 | Neveras et al. | 215/237 X |
| 5,573,127 | 11/1996 | Takahashi et al. | 215/237 |
| 5,620,107 | 4/1997 | Takeuchi | 220/235 |
| 5,702,033 | 12/1997 | Beaver | 222/556 X |

*Primary Examiner*—Kenneth Bomberg
*Attorney, Agent, or Firm*—Silverman, Cass & Singer, Ltd.

[57] ABSTRACT

A hinged closure including a lid hingedly connected to a base positioned upon a container for dispensing of the contents thereof. The base is formed with an upper wall including an angled deck surface. The lid has a peripheral wall with a portion thereof of reduced thickness to permit flexing thereof. When the lid is in closed position over the base, the reduced thickness portion of the lid is disposed adjacent to the angled deck surface. Upon exertion of a force against said reduced thickness portion of the lid, said portion flexes inwardly and a terminal edge thereof ramps upwardly on the angled deck surface to cause the lid to pivot into open position with respect to the base.

20 Claims, 2 Drawing Sheets

5
77
80
16
20
40
38
22
70
72
74
14
24
56
50
12
10
54
52
18
76
34

40
38
39
70
76
72
74
14
24
32
30
60
61
77
80
54
20
16
22
63
50
63
12
56
10
52
18
28
26
34

HINGED DISPENSING CLOSURE

BACKGROUND OF THE INVENTION

1. Field of the Invention

This invention relates generally to hinged dispensing closures for containers and more particularly, to snap-open type closures in which the lid snaps away from the base to permit product to be dispensed from such containers.

2. Description of the Prior Art

Hinged dispensing closures for containers are known, as represented in the prior art patents of record herein. Such closures commonly include a pivotally mounted lid hingedly connected to a base and capable of being moved between a closed and an open dispensing position. In the closed position, the lid covers a dispensing opening formed in the base, and in the open position, the lid is moved away from the opening to permit product to be dispensed from the container.

Prior art closures with pivotally mounted lids also are known to include hinge constructions to maintain the lid in open position away from the base without an outside restraining force, and also to maintain the lid in closed position over the base such as by friction fit of matingly engagable parts between the lid and the base. Representative illustrations of such closures are disclosed in U.S. Pat. Nos. 4,793,502 and 5,007,555 which are owned by the same assignee as the assignee of the present application. The disclosures of said commonly owned patents hereby are incorporated herein by reference.

It is desirable to provide a convenient and expedient structure for causing the lid of such closures to snap open with respect to the base to permit dispensing of the contents of the container on which such closure is mounted. Preferably, such structure is operable upon engagement of a single digit on a hand of the user so that a container is openable with minimal effort and inconvenience.

SUMMARY OF THE INVENTION

The invention provides a snap-open type hinged dispensing closure including a lid connected to a base at a hinge. The lid is retained in closed position by engagement, for example, of a depending plug on the inner surface of the lid which is disposed over a spout formed on an upper wall of the base. Alternatively, mating undercuts could be formed between mating surfaces on the lid and the base to effect removable engagement therebetween. The lid is of generally cup-shaped configuration with a front wall disposed opposite a rear wall to which the hinge joinder with the base is disposed. The front wall is of reduced thickness with respect to the remainder to the lid to permit flexing of said front wall when a user engages same with a digit, such as the thumb of the user's hand. The upper wall of the base is formed with an angled deck surface juxtaposed the front wall of the lid when the same is in closed position over the base. When the user pushes against the front wall with a digit of the user's hand, the wall flexes inwardly causing a lower edge of the lid adjacent to the front wall to ramp upwardly on the angled deck surface of the base. This action causes the lid to pivot about the hinge with respect to the base to effect snap opening of the closure.

DESCRIPTION OF THE PREFERRED EMBODIMENT

Figure 1:
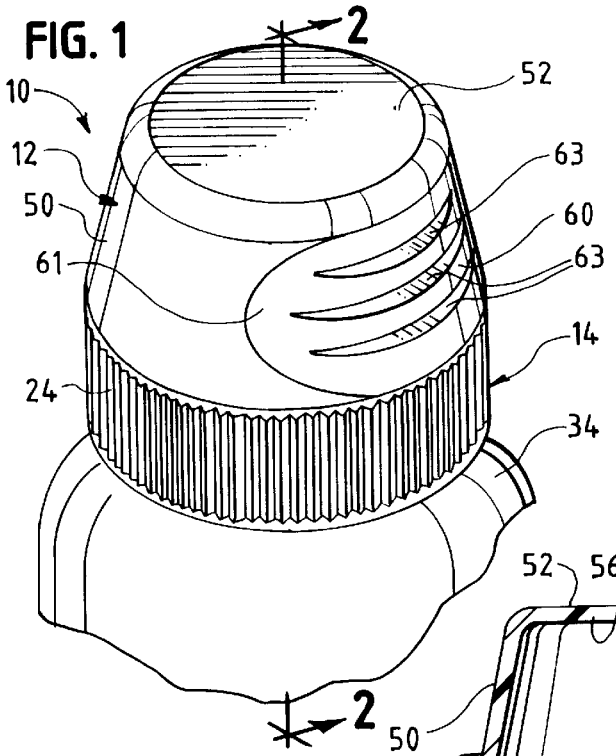
FIG. 1 is a perspective view of the hinged dispensing closure of the invention, the same being shown installed in closed position on a container neck.

The hinged dispensing closure 10 of the invention includes a lid 12 connected to a base 14 by a hinge 16. Hinge 16 is positioned between a rear portion 18 of lid 12 and a rear portion 20 of upper wall 22 of base 14.

Base 14 includes a body portion 24 formed with threads 26 on the inner surface 28 thereof for engagement with mating threads 30 formed on the neck 32 of a container 34. Upper wall 22 extends from body portion 24 and a spout 38 is formed thereon defining a passageway 39 terminating in opening 40 to permit product in container 34 to be dispensed therethrough.

Hinge 16 can be formed in the configuration of any structure, such as, but not limited to, the snap-open hinges disclosed in U.S. Pat. Nos. 4,793,502 or 5,007,555. Other hinges, including non snap-open type hinges, are contemplated to be within the scope of the present invention and may be used on the closure thereof.

Lid 12 is of generally cup-shaped configuration, including a peripheral wall 50 of generally circular cross-sectional configuration, and top wall 52. A depending plug 54 is formed on the underside 56 of top wall 52 and is positioned to be in registry with opening 40 of spout 38 when the lid is disposed in closed relationship with respect to base 14 (see FIG. 2). The cross-sectional dimension of plug 54 is slightly less than the cross-sectional dimension of spout 38 so that there will be a friction-fit of plug 54 over spout 38 when the lid is disposed in closed relationship with respect to base 14. In this manner, the engagement of plug 54 over spout 38 maintains the lid 12 in closed position over base 14 until the same is opened. Alternatively, matingly engagable undercuts (not shown) could be formed between lid 12 and base 14 to retain same in closed position until opening of the lid is desired.

Figure 3:
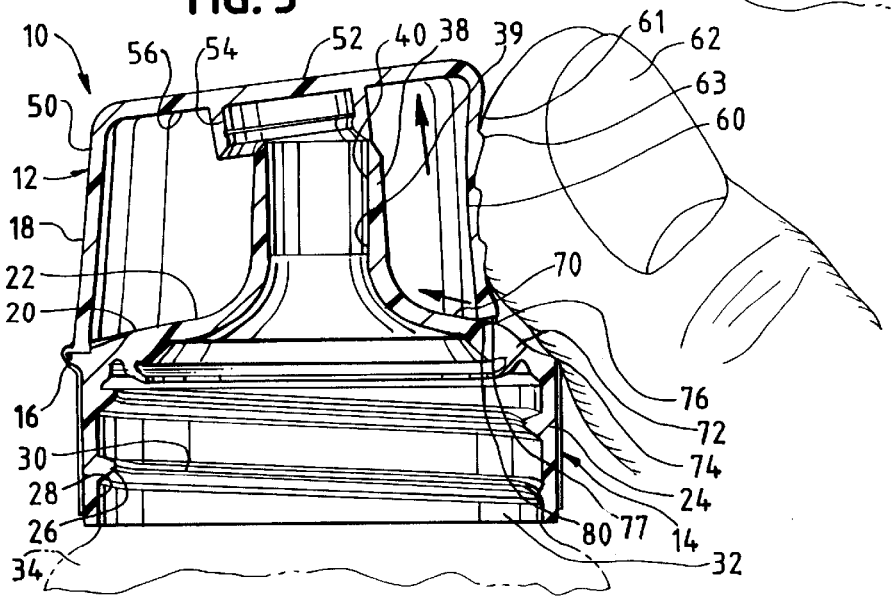
FIG. 3 is a sectional view similar to that of FIG. 2, with the front wall of the lid being shown in flexed condition upon assertion of a force thereagainst by a digit of the hand of a user.
Figure 4:
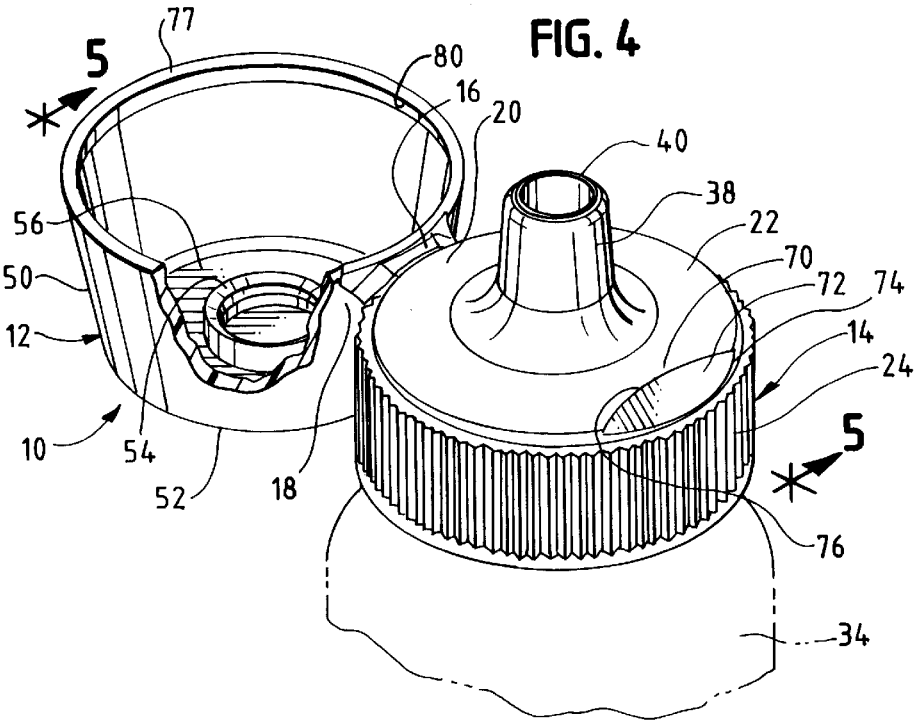
FIG. 4 is a perspective view of the hinged dispensing closure of the invention, the same being shown in open position on a container neck.
Figure 5:
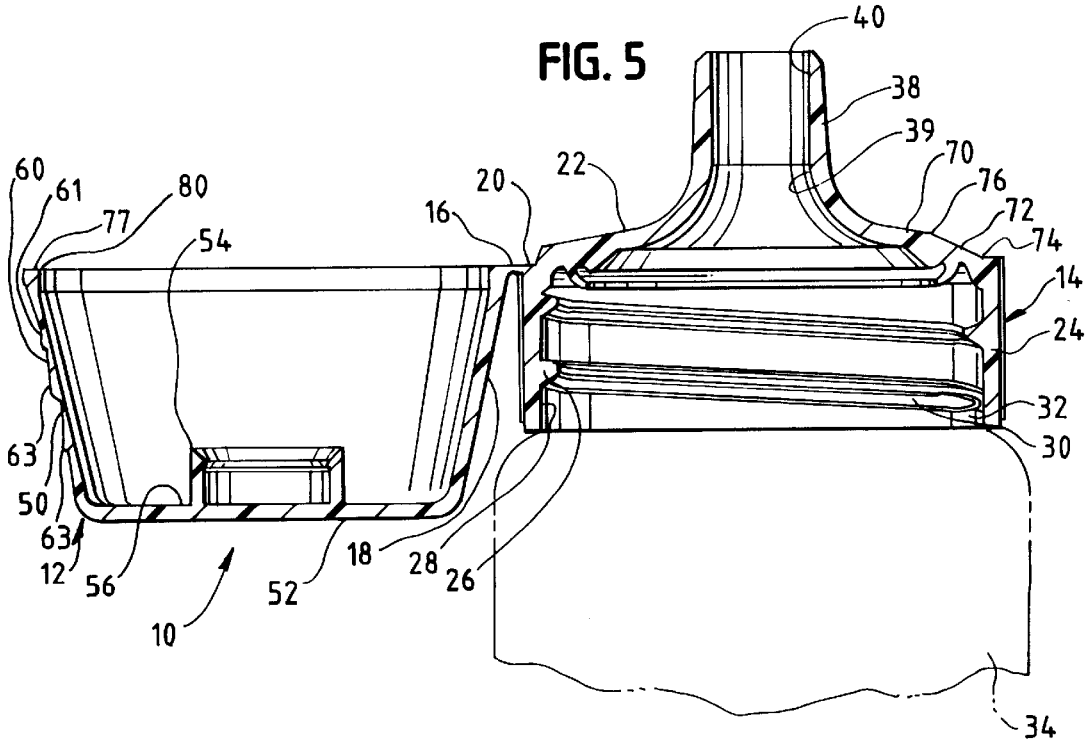
FIG. 5 is a sectional view taken along the line 5—5 of FIG. 4 in the direction indicated generally.

The cross-sectional thickness of all portions of peripheral wall 50, except that of front wall portion 60 thereof, are substantially uniform. Front wall portion 60 is formed of a cross-sectional thickness which is less than that of the remaining portions of peripheral wall 50 to permit said front wall portion 60 to be flexed readily upon exertion of a force thereagainst, such as by pushing by a digit 62 of a user's hand (see FIG. 3). The external surface 61 of front wall portion 60 may be formed with protruding ridges 63 to enhance the gripping force exerted by a user's digit and prevent slipping of the digit along the surface 61.

Upper wall 22 of base 14 is generally planar except proximate front portion 70 which is located diametrically opposite that of rear portion 20. Front portion 70 is formed as an angled deck surface 72 and is of generally crescent-shaped configuration. A portion of deck surface 72 terminates along the periphery 74 of upper wall 22 at an elevation which is lower than the oppositely disposed portion 76 of deck surface 72 which terminates at the plane of upper wall 22.

When the lid 12 is positioned over base 14 in closed position, plug 54 engages spout 38 and peripheral terminating edge 80 of lid 12 is engaged proximate upper wall 22 of base 14. When it is desired to open the closure 10, a user engages a digit 62 of a hand against front wall portion 60 and pushes against said front wall portion. Such action causes front wall 60 to flex inwardly causing the area 77 of terminating edge 80 adjacent wall portion 60 to ride along angled deck surface 72 and ramp upwardly on said deck surface. This action causes the lid 12 to pivot about hinge 16 to release plug 54 from spout 38 to effect opening of the closure (see FIG. 3).

Figure 2:
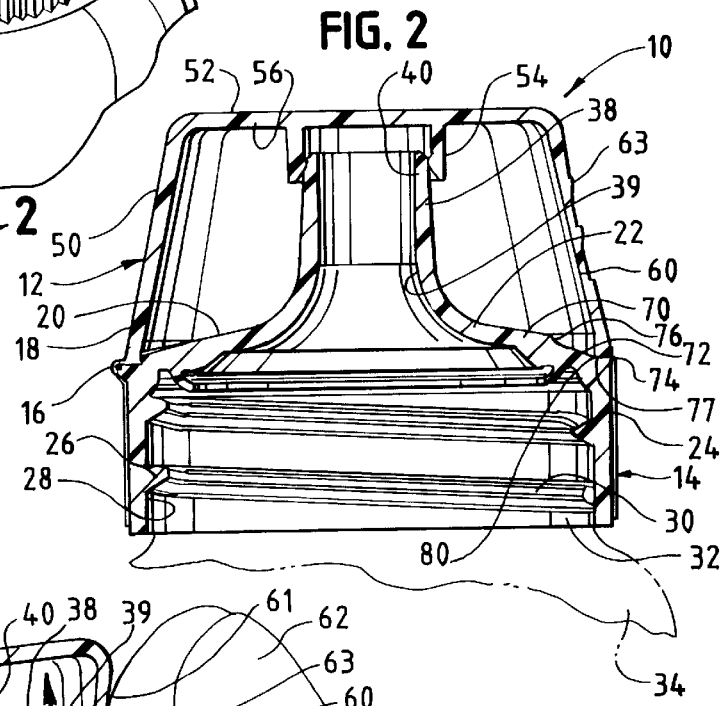
FIG. 2 is a sectional view taken along the line 2—2 of FIG. 1, in the direction indicated generally.

Upon release of the force of digit 62 against front wall portion 60, the same resumes its unflexed condition, permitting lid 12 to be re-engaged over base 14 to close the closure as seen in FIGS. 1–2.

Minor variations in the structure and other variations in the arrangement and size of the various parts may occur to those skilled in the art without departing from the spirit or circumventing the scope of the invention as set forth in the appended claims.

I claim:

1. A hinged dispensing closure for a container having a neck, the container adapted to retain product to be dispensed therefrom, said closure comprising, a base for placement on said neck, a lid pivotally connected to said base at a hinge, said base including a body portion engaged upon said neck and an upper wall extending from said body portion, a passageway formed in said upper wall to permit the product in said container to be dispensed therethrough, said lid being pivotal about said hinge to a first position in which the lid is engaged over said base to close said passageway and prevent the product from being dispensed, said lid having a rear wall and said hinge being connected to the lid proximate said rear wall, said lid having a front wall disposed at a location spaced from said rear wall, the front wall terminating at a lower edge which engages the upper wall of the base when the lid is in said first position, said front wall being of reduced thickness with respect to the remaining portions of the lid to permit flexing of said front wall when a force is applied thereto, said upper wall of the base including an angled deck surface juxtaposed the front wall of the lid when the lid is in the first position, whereby upon exertion of said force against said front wall the front wall flexes to move the lower edge along the angled deck surface causing the front wall to ramp upwardly on the angled deck surface and pivotally move the lid from said first position to a second position in which the lid is disengaged from said base and said passageway is opened.

2. A closure as claimed in claim 1 in which said upper wall of the base includes a spout formed thereon and said passageway is positioned in said spout.

3. A closure as claimed in claim 2 in which said lid is of generally cup-shaped configuration having a top wall covering said front and rear walls, a plug depending from said top wall and positioned to be in registry with said spout when the lid is in said first position.

4. A closure as claimed in claim 1 in which said base is threadedly engaged upon said neck.

5. A closure as claimed in claim 1 in which said hinge is a snap-open hinge.

6. A closure as claimed in claim 3 in which said lid is of generally circular cross-sectional configuration.

7. A closure as claimed in claim 1 in which said front wall includes at least one protruding ridge formed thereon.

8. A closure as claimed in claim 1 in which said upper wall is generally planar except in the area proximate said angled deck surface, said angled deck surface being of generally crescent-shaped configuration, said deck surface having a first portion which terminates along a peripheral edge of said upper wall at an elevation which is lower than another portion of said deck surface which is oppositely disposed with respect to said first portion.

9. A closure as claimed in claim 8 in which the lower edge of the lid which terminates at the front wall is disposed adjacent the first portion of said deck surface when the lid is in said first position.

10. A closure as claimed in claim 9 in which said lower edge moves from a position adjacent the first portion of the deck surface to said other portion of the deck surface when the force is exerted against said front wall of the lid.

11. In combination, a container having a neck and a hinged dispensing closure for said container, said container adapted to retain product to be dispensed therefrom, said closure comprising, a base for placement on said neck, a lid pivotally connected to said base at a hinge, said base including a body portion engaged upon said neck and an upper wall extending from said body portion, a passageway formed in said upper wall to permit the product in said container to be dispensed therethrough, said lid being pivotal about said hinge to a first position in which the lid is engaged over said base to close said passageway and prevent the product from being dispensed, said lid having a rear wall and said hinge being connected to the lid proximate said rear wall, said lid having a front wall disposed at a location spaced from said rear wall, the front wall terminating at a lower edge which engages the upper wall of the base when the lid is in said first position, said front wall being of reduced thickness with respect to the remaining portions of the lid to permit flexing of said front wall when a force is applied thereto, said upper wall of the base including an angled deck surface juxtaposed the front wall of the lid when the lid is in the first position, whereby upon exertion of said force against said front wall the front wall flexes to move the lower edge along the angled deck surface causing the front wall to ramp upwardly on the angled deck surface and pivotally move the lid from said first position to a second position in which the lid is disengaged from said base and said passageway is opened.

12. The combination as claimed in claim 11 in which said upper wall of the base includes a spout formed thereon and said passageway is positioned in said spout.

13. The combination as claimed in claim 12 in which said lid is of generally cup-shaped configuration having a top wall covering said front and rear walls, a plug depending from said top wall and positioned to be in registry with said spout when the lid is in said first position.

14. The combination as claimed in claim 11 in which said base is threadedly engaged upon said neck.

15. The combination as claimed in claim 11 in which said hinge is a snap-open hinge.

16. The combination as claimed in claim 13 in which said lid is of generally circular cross-sectional configuration.

17. The combination as claimed in claim 11 in which said front wall includes at least one protruding ridge formed thereon.

18. The combination as claimed in claim 11 in which said upper wall is generally planar except in the area proximate said angled deck surface, said angled deck surface being of generally crescent-shaped configuration, said deck surface having a first portion which terminates along a peripheral edge of said upper wall at an elevation which is lower than another portion of said deck surface which is oppositely disposed with respect to said first portion.

19. The combination as claimed in claim 18 in which the lower edge of the lid which terminates at the front wall is disposed adjacent the first portion of said deck surface when the lid is in said first position.

20. The combination as claimed in claim 19 in which said lower edge moves from a position adjacent the first portion of the deck surface to said other portion of the deck surface when the force is exerted against said front wall of the lid.

* * * * *